US009683810B2

(12) United States Patent
Perkinson

(10) Patent No.: US 9,683,810 B2
(45) Date of Patent: Jun. 20, 2017

(54) SHOOTER'S GUN CASE, TABLE COMBO

(71) Applicant: Patrick Douglas Perkinson, Smithfield, KY (US)

(72) Inventor: Patrick Douglas Perkinson, Smithfield, KY (US)

( * ) Notice: Subject to any disclaimer, the term of this patent is extended or adjusted under 35 U.S.C. 154(b) by 0 days.

(21) Appl. No.: 14/948,316

(22) Filed: Nov. 21, 2015

(65) Prior Publication Data

US 2016/0290762 A1 Oct. 6, 2016

Related U.S. Application Data

(60) Provisional application No. 62/177,939, filed on Mar. 30, 2015.

(51) Int. Cl.

| | |
|---|---|
| ***A47B 3/10*** | (2006.01) |
| ***F41C 33/06*** | (2006.01) |
| ***F41A 23/16*** | (2006.01) |

(52) U.S. Cl.

CPC ..... *F41C 33/06* (2013.01); *A47B 3/10* (2013.01); *F41A 23/16* (2013.01)

(58) Field of Classification Search

CPC ..... F41C 33/06; A47B 2003/145; A47B 3/10; A47B 37/00; Y10S 224/911; Y10S 224/913

USPC ..... 108/167–169, 171, 172, 14, 34–36, 38, 108/125, 129

See application file for complete search history.

(56) References Cited

U.S. PATENT DOCUMENTS

| | | | | | |
|---|---|---|---|---|---|
| 1,426,962 | A * | 8/1922 | Corpstein | A47B 3/10 | 108/35 |
| 2,121,982 | A * | 6/1938 | Pugsley | F41C 23/14 | 206/305 |
| 2,522,642 | A * | 9/1950 | Schmidt | A47B 3/14 | 108/36 |
| 2,645,037 | A * | 7/1953 | Talone | F41G 3/26 | 434/19 |
| 2,647,562 | A * | 8/1953 | Hoffar | A47B 3/14 | 108/35 |
| 2,827,352 | A * | 3/1958 | Boyajian | A47B 3/10 | 108/35 |
| 3,401,995 | A * | 9/1968 | Ogden | A47B 13/003 | 108/158 |
| 3,811,562 | A * | 5/1974 | Smith | F41C 33/06 | 206/317 |

(Continued)

FOREIGN PATENT DOCUMENTS

DE 10238155 * 11/2003

*Primary Examiner* — Janet M Wilkens

(74) *Attorney, Agent, or Firm* — Witters & Associates

(57) ABSTRACT

A shooter's case and table combo configured to convert from a gun carrying case into a shooter's table, using no tools, is presently disclosed. The shooter's case and table combo has two identical rectangular panels attached in the center with a hinge. Each panel has a slot proximate each end, each slot formed by a respective end of the panel and a respective leg mount. Four identical length legs are configured to be constrained inside the panels and each of the legs having a top end configured to be placed in one of the slots in one of the panels. A pair of retaining pins are provided for each leg, each of the pair of retaining pins being configured to be received by a pair of apertures in the leg mount and a pair of apertures in the legs and hold the leg to the panel.

5 Claims, 1 Drawing Sheet

(56) References Cited

U.S. PATENT DOCUMENTS

| | | | | | |
|---|---|---|---|---|---|
| 4,064,812 | A * | 12/1977 | Commanda | A47B 3/083 | 108/132 |
| 4,446,900 | A * | 5/1984 | Markovich | A45C 13/02 | 206/317 |
| 4,535,559 | A * | 8/1985 | Hall | F41A 23/00 | 42/94 |
| 4,702,029 | A * | 10/1987 | DeVaul | F41C 33/06 | 42/94 |
| 7,546,920 | B1 * | 6/2009 | Horn | F41C 33/06 | 206/317 |
| 2004/0144664 | A1 * | 7/2004 | Hammill | F41C 33/06 | 206/317 |
| 2010/0089294 | A1 * | 4/2010 | Medina | A47B 3/0913 | 108/25 |
| 2016/0345739 | A1 * | 12/2016 | McCullough | A47C 4/02 | |

* cited by examiner

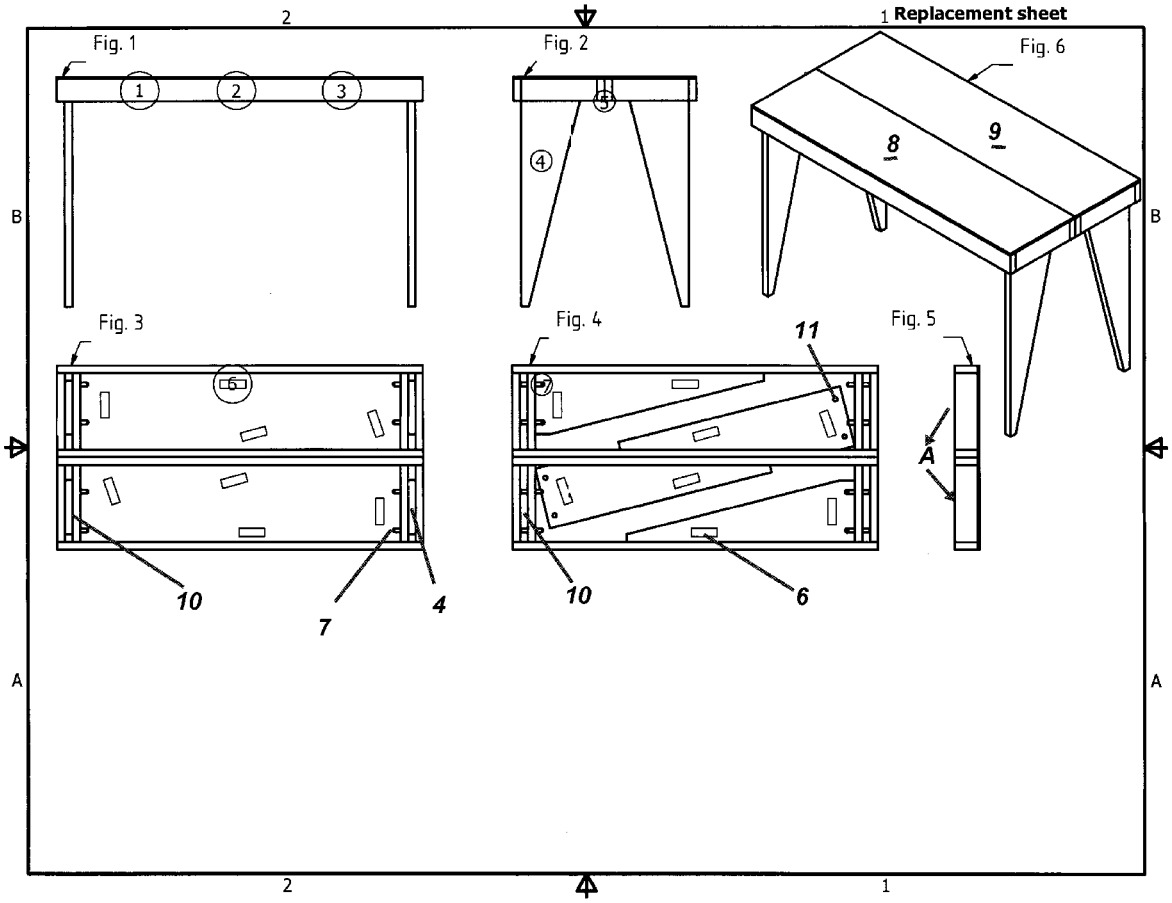
Replacement sheet
Fig. 1
Fig. 2
Fig. 3
Fig. 4
Fig. 5
Fig. 6
1
2
3
4
5
6
7
8
9
10
11
A
B

SHOOTER'S GUN CASE, TABLE COMBO

BACKGROUND OF THE INVENTION

This invention relates to collapsible, portable shooter's tables, and is more particularly directed to a carrying case for a target rifle which can double as a shooter's table.

Shooter's tables are commonly found at target ranges. These are employed for holding or steadying a target rifle, because the accuracy and range of modern rifles and affiliated sighting equipment is such that optimum marksmanship is possible only if the rifle is held steady. This degree of steadiness is impossible if the shooter supports the rifle without the use of a rest.

In addition to fixed-location shooting benches, various portable gun rests, such as monopod, bipod, and tripod rests have been introduced, as have several portable shooting benches. A tripod type shooting bench, having a gun rest of adjustable height and a collapsible portable stool for the shooter, is described in Hall U.S. Pat. No. 4,535,559. This bench is a rather small affair, and although highly portable, does not afford the shooter a good surface on which to rest his or her elbows when shooting. Another portable shooter's bench is described in U.S. Pat. No. 4,506,466, which includes a table-type gun rest with an associated seat, both of which are supported on collapsible or folding legs. This device is intended for right handed shooters, and is not easily reversed for use by left handed shooters.

A shooter's bench and table assembly, which incorporates a chest for storing a rifle, is described in U.S. Pat. No. 4,565,403. This assembly is a rather massive affair, with a table surface and legs which nest together on top of or beneath the chest. Also, the table is of a shape that does not provide an optimum shooting position, whether for right or left handed shooters.

Of course, it is desirable both for target shooting and fi-r sport shooting to be able to carry and set up the rifle and the shooter's table under a variety of field conditions, many of which may involve quite uneven terrain. It is also desirable for sport shooting, i.e., hunting, at extreme range, to set up the rifle on a shooting table. However, the amount of equipment for such sport shooting should of necessity be kept to an absolute minimum. For that reason, the bench should be as light-weight and compact as possible, and should be serviceable under any of a variety of field conditions. Also, the shooter or hunter should be able to transport both the rifle and the shooter's table without encumbering themselves with a large number of separate pieces of equipment.

OBJECTS AND SUMMARY OF THE INVENTION

Accordingly, it is an object of this invention to provide a shooter's table which is useful in field conditions, and is also light-weight and portable.

It is a more specific object of this invention to provide a gun case for secure storage and protection of fine, high quality target rifles, and which gun case can double as a field-type shooter's table.

It is another object of this invention to provide a combination gun case and shooter's table which when set up accommodates either right handed or left handed shooters.

It is an object of this invention to provide a combination gun case and field shooter's table in which all of the required shooting equipment can be carried as a single package. According to an aspect of this invention, the Shooter's gun case, table combo is provided as a light-weight carrying case suitably dimensioned for storing and carrying a target rifle, and which can be converted for use as a shooter's table by attaching four light-weight legs, affixing them with the eight locking pins, and turning it over. The legs and pins are stored inside the case under the foam with the rifle.

The casing can be injection molded from a suitably strong plastic resin, such as high density polyethylene, and the casing can be lined with soft, thick convoluted foam padding. The case is also provided with locking draw bolts for securing the case for storage or transport.

The above and many other objects, features and advantages of this invention will be more fully understood from the ensuing detailed description.

BRIEF DESCRIPTION OF THE DRAWING

The following Figures, which are idealized, are not to scale and are intended to be merely illustrative of aspects of the present disclosure and non-limiting. The drawings are briefly described as follows.

FIG. 1 is a front view of a shooter's gun case of the present disclosure;

FIG. 2 is an end view of the shooter's gun case shown in FIG. 1;

FIG. 3 is bottom view of the shooter's gun case shown in FIG. 1 having the legs installed;

FIG. 4 is bottom view of the shooter's gun case shown in FIG. 1 having the legs placed in the case;

FIG. 5 is an end view of the shooter's gun case shown in FIG. 1 having the legs placed in the case; and FIG. 6 is an upper perspective view of the shooter's gun case shown in FIG. 1;

DETAILED DESCRIPTION

With reference to FIGS. 1-6, the presently claimed shooter's gun case, table combo is described. The presently disclosed shooter's case and table combo is configured to convert from a gun carrying case into a shooter's table using no tools. The shooter's case and table combo comprises two identical rectangular panels, 8 and 9, attached in the center with a full length hinge 5. Hinge 5 is configured for hingedly attaching the panels together and enabling a 180° rotation of one of the panels, 8 or 9, with respect to the other panel, the other of 8 and 9. Each panel 8 and 9 has a slot 10 proximate each end of the panel. Each slot 10 is formed by a respective end of the panel and a respective leg mount. Each leg mount has a pair of spaced apertures configured for removably receiving retaining pins 7. Four identical length legs 4 are configured to be constrained inside panels 8 and 9, upon converting the shooter's case and table combo into the case by rotating at least one of the panels 8 and 9 about hinge 5, 180° toward the other panel, as indicated with "A", FIG. 5. Each leg 4 has a top end configured to be placed in one of slots 10, in one of the panels 8 or 9, each slot 10 formed by a respective end of the panel and a respective leg mount. A pair of spaced apertures 11 are proximate a top edge of each of the legs 4, the pair of apertures 11 in legs 4 are configured and disposed to align with the pair of apertures in the leg mount, upon placing leg 4 in slot 10. A pair of retaining pins 7 is provided for each leg 4, each of the pair of retaining pins 7 is configured to be received by the pair of apertures in the leg mounts and the pair of apertures 11 in the legs and hold leg 4 to panel 8 or 9.

The shooter's case and table combo may be configured to store and hold a rifle between panels 8 and 9, upon converting the shooter's case and table combo into the case. The shooter's case and table combo may have a pair of foam pads, each foam pad having a perimeter proximate a perimeter of a panel 8 or 9, configured to store and hold a rifle therebetween. The shooter's case and table combo may have hook and loop fasteners 6 on an inner side of panels 8 and 9 and on the legs 4, the hook and loop fasteners 6 being configured and disposed to removably hold legs 4 to panels 8 and 9. Latches, as are known by persons having ordinary skill in the art, may be attached proximate positions 1 and 3 on panels 8 and 9. Handle(s), as are known by persons having ordinary skill in the art, may be attached proximate position 2 on panels 8 and/or 9. The shooter's case and table combo may have retaining pins 7 with a length greater than a width of slots 10 by an amount for grasping retaining pins 7 and removing them from slots 10 without the use of tools.

In at least one embodiment, a portable gun carrying case with standard foam inserts that has legs hidden inside under the foam is disclosed. After the gun/rifle is removed, the legs are pinned into place using the supplied pins. Once the legs are pinned into place the case/table is turned over onto the legs making it a table to be used for a shooting bench/table/rest.

In at least one illustrative example of the presently disclosed Shooter's gun case/table combo, FIG. 1—Indicates the side view of the assembled Shooter's gun case/table combo. FIG. 1—(1,3) Indicate latch locations. FIG. 1 (2) Indicates handle location. FIG. 2—Indicates end view of assembled Shooter's gun case/table combo. FIG. 2—(5) Indicates full length hinge location. FIG. 2—(4) Indicates one of the four legs in the installed (table) position. FIG. 3—Indicates the bottom view of the assembled Shooter's gun case/table combo. In this view, all legs (4) are installed in the leg retaining slots and held in place by the leg retaining pins (7). FIG. 3—(6) All rectangles indicate approximate size and location of the adhesive backed hook and loop used to keep the legs in place during transport. FIG. 4—Indicates bottom view of Shooter's gun case/table combo with all four legs removed from leg retaining slots at ends and affixed inside the case. The loop side of the adhesive backed hook and loop is installed on each leg and corresponds and aligns with the hook side previously affixed to the inside panel of the case. FIG. 3 (6). FIG. 4—(7) Indicates one of the eight total leg retaining pins installed in the leg retaining pin hole as are the rest. FIG. 5—Indicates open end view of FIG. 4 with all four legs inside and out of sight. FIG. 6—Indicates isometric view of assembled Shooter's gun case/table combo for overall perspective.

In at least one other illustrative example, a shooter's gun case, table combo having two halves of exact size and shape is connected in the center with a full length hinge and secured with two or more latches when closed. It is sufficiently sized to house a target/hunting rifle when the two halves are closed. The leg mounts are built into the halves at the ends. The four legs, one on each corner, are housed underneath the foam and affixed to the inner panel of each half with hook and loop connectors while being used as a carrying case. The shooter's case, table combo is designed to convert from a gun carrying case into a shooter's table in a matter of seconds and vice versa.

In at least one additional illustrative example, the shooter's case, table combo is designed to convert from a gun carrying case into a shooter's table in a matter of seconds and vice versa, using no tools and utilizing two identical rectangular halves attached in the center with a full length hinge and our identical fixed length legs constrained to the inside panels underneath the protective foam with rectangular shaped adhesive backed hook and loop.

In at least one further illustrative example, the four legs, one on each corner for stability, used for the table that are all the same fixed length, are installed into the built in leg retaining slots and attached with the eight supplied leg retaining pins by installing the leg retaining pins through the holes in the inside leg retaining slot walls and the corresponding holes in the legs locking them in place.

In at least another illustrative example, the shooter's gun case is designed to be strong, simple, and so light that one person can carry and set it up utilizing the rectangular shaped adhesive backed hook and loop provides the lightest solution possible for securing the legs inside underneath the foam for transport.

In at least one illustrative example, this configuration allows the complete separation of the rifle or items being stored inside and the legs being stored inside by the foam barrier in between them to provide maximum protection for the firearm or items.

In at least one other illustrative example, all leg retaining slots are built on the inside ends of the identical rectangular halves for stability and aesthetics when legs are installed and when they are stored inside under the foam.

In at least one additional illustrative example, the protective foam being used is 1.3 density flat packaging foam but different foams and configurations can be utilized for different applications.

In at least one further illustrative example, the eight leg retaining pins add further stability to the assembled table keeping the legs from moving around during use.

In at least another illustrative example, the rectangular halves have a convenient carrying handle and latches to keep the Shooter's gun case/table combo closed during transport.

In at least one aspect of the present disclosure of this disclosure, this invention was designed to combine the use of a gun carrying case and a table from which to target shoot, fish, camp, and hunt. I'm sure some people would find it useful for lakeside fishing or camping as well. This Shooter's gun case, table combo can be manufactured from a variety of different plastics, wood, fiberglass, metal, carbon fiber, ect . . . and in several different size configurations. My prototypes and early models will be made from wood and utilize slots and pins for the legs, but I hope to eventually utilize plastics or carbon fiber and the legs can also be built in. The legs can be constructed to be permanently pinned into the case. The legs can then be rotated into place utilizing a built in latch to lock them into place.

This invention is built similar to a standard gun carrying case but with several added differences and features. It has legs and can be configured into a shooting table in seconds!

This is how it works . . . lay the Shooter's gun case, table combo on the ground, unlatch the latches, and rotate the top open 180 degrees. Next, if you have a gun inside remove it. Now remove the egg crate foam pieces and set them aside. Next step, remove the legs one at a time and install them into the corresponding numbered slots one at a time aligning the pin holes. Remove the pins from the hook and loop pad and install them into the location support holes all the way through the supports and legs locking them in place. Now, at this time, the table is assembled but upside down. Grasp the Shooter's gun case, table combo assembly in the center, raise it straight up, rotate it toward yourself 180 degrees, and then set it back down on it's legs.

Now you're ready to shoot. Use it for all of your shooting, camping, and fishing needs.

When finished, go through all of the above steps in reverse utilizing the preinstalled hook and loop pads to secure the legs and locking pins inside. Close it up and you're ready to go.

The shooting table of this invention is quickly and easily set up and can be used for any of a variety of shooters, and accommodate left handed or right handed shooting. The gun other shooting equipment can be readily stored and carried.

While the invention has been described in detail with respect to a preferred embodiment, it should be understood that the invention is not limited to that embodiment, but that many modifications and variations thereof would present themselves to those of skill in the art without departing from the scope and spirit of this invention, as defined in the appended claims.

What is claimed is:

1. A shooter's case and table combo is configured to convert from a gun carrying case into a shooter's table, using no tools, the shooter's case and table combo comprising:

two identical rectangular panels attached in the center with a full length hinge, hingedly attaching the panels together and enabling a 180° rotation of one of the panels with respect to the other panel;

each panel having a slot proximate each end of the panel, each slot formed by a respective end of the panel and a respective leg mount;

each leg mount having a pair of spaced apertures;

four identical length legs configured to be constrained inside the panels, upon converting the shooter's case and table combo into the case by rotating at least one of the panels about the hinge 180° toward the other panel;

each of the lees having a top end configured to be placed in one of the slots in one of the panels;

a pair of spaced apertures proximate a top edge of each of the legs, the pair of apertures in the legs being configured and disposed to align with the pair of apertures in the leg mount upon placing the leg in the slot; and a pair of retaining pins for each leg, each of the pair of retaining pins being configured to be received by the pair of apertures in the leg mounts and the pair of apertures in the legs and hold the leg to the panel.

2. The shooter's case and table combo of claim 1 being configured to store and hold a rifle between the panels upon converting the shooter's case and table combo into the case.

3. The shooter's case and table combo of claim 2 further comprising a pair of foam pads, each foam pad having a perimeter proximate a perimeter of the panels and being configured to store and hold the rifle therebetween.

4. The shooter's case and table combo of claim 1 further comprising hook and loop fasteners on an inner side of the panels and on the legs, the hook and loop fasteners being configured and disposed to removably hold the legs to the panels.

5. The shooter's case and table combo of claim 1 wherein the retaining pins have a length greater than a width of the slots by an amount for grasping the retaining pins and removing the retaining pins from the slots without the use of tools.

* * * * *